US006886571B2

(12) United States Patent
Takeda

(10) Patent No.: US 6,886,571 B2
(45) Date of Patent: May 3, 2005

(54) MAKE-UP SET AND COSMETIC STORAGE CASE

(76) Inventor: Shiro Takeda, 3538-3, Kumanocho, Aki-gun, Hiroshima 731-4214 (JP)

( * ) Notice: Subject to any disclaimer, the term of this patent is extended or adjusted under 35 U.S.C. 154(b) by 156 days.

(21) Appl. No.: 10/240,847

(22) PCT Filed: Apr. 4, 2001

(86) PCT No.: PCT/JP01/02926

§ 371 (c)(1),
(2), (4) Date: Feb. 11, 2003

(87) PCT Pub. No.: WO01/74193

PCT Pub. Date: Oct. 11, 2001

(65) Prior Publication Data

US 2003/0145872 A1 Aug. 7, 2003

(30) Foreign Application Priority Data

Apr. 4, 2000 (JP) ..... 2000-102704

(51) Int. Cl.[7] ..... A45D 40/24
(52) U.S. Cl. ..... 132/318
(58) Field of Search ..... 132/318, 316, 132/313, 317, 297; 401/78, 126, DIG. 1, 68, 69

(56) References Cited

U.S. PATENT DOCUMENTS

| | | | | | |
|---|---|---|---|---|---|
| 5,234,275 | A | * | 8/1993 | Gueret | 401/78 |
| 5,860,755 | A | * | 1/1999 | Bunk | 401/52 |
| 5,860,756 | A | * | 1/1999 | Fabrisi | 401/78 |
| 5,979,468 | A | * | 11/1999 | Blake | 132/318 |
| 6,082,372 | A | * | 7/2000 | Mizukaki | 132/318 |
| 6,513,536 | B1 | * | 2/2003 | Demellier et al. | 132/318 |

OTHER PUBLICATIONS

Microfilm of the specification and drawings annexed to the request of Japanese Utility Model Application No. 184501/1981 (Laid–open No. 88914/1983) (Yoshino Kogyosho Co., Ltd.), Jun. 16, 1983, Full text; all drawings (Family: none).

* cited by examiner

*Primary Examiner*—John J. Wilson
*Assistant Examiner*—Robyn Kien Doan
(74) *Attorney, Agent, or Firm*—Wenderoth, Lind & Ponack, L.L.P.

(57) ABSTRACT

A method of storing a cosmetic is capable of retrieving and storing a make up set and the cosmetic from a case by a single hand operation. The cosmetic is stored in a covered tubular case so as to be retrieved and stored and locked to the tubular case when projected and stored by the single hand operation. The cover of the tubular case is opened when the cosmetic is projected and closed when the cosmetic is stored.

4 Claims, 8 Drawing Sheets

MAKE-UP SET AND COSMETIC STORAGE CASE

BACKGROUND

1. Technical Field

The present invention relates to a storage case that is designed to store a makeup set such as a facial brush or a cosmetic article such as a lipstick or rouge. More particularly, the present invention relates to a storage case that is designed to store such a makeup set or cosmetic article, wherein the storage case is equipped with a lid or cover on its front end side, and is constructed to permit the user to open or close the lid by a single hand operation and to move the makeup set or cosmetic article out of and back into the storage case by the single hand operation.

2. Prior Art

There are several conventional types of storage cases that are designed to store a makeup set or cosmetic article. For example, one type of the storage case includes a main body and a cover, both of which are threaded to permit them to engage each other. The cover may be detachably attached to the main body by turning either of them relative to the other. Another type of the storage case includes a main body and a cover, in which the cover may be fitted over the main body, and may remain to be mounted on the main body by the frictional force. Other types are also known, although they are not described specifically.

In most of those conventional storage cases, when the cover is to be attached to or detached from the main body, this must be accomplished by using both hands, and when a makeup set or cosmetic article stored in the storage case is to be moved out of or back into the storage case, this must also be accomplished by using both hands. In other words, those operations cannot be done by a single hand.

For the type of the storage case that is specifically designed to store a facial brush or simply a brush, in most cases, the brush has soft hairs on a tip side that tend to expand themselves more than the cross-sectional area of the storage case when the brush is projected out of the storage case through the front end side thereof. When the brush is then moved back into the storage case, it may make contact with the front end of the storage case. The brush may carry any cosmetic material applied to the user's face after it is used. The cosmetic material thus attached to the brush may also be attached to the exterior of the storage case when the brush is being moved through the open end side back into the storage case. Thus, the exterior of the storage case may be stained with the cosmetic material.

SUMMARY OF THE INVENTION

The present invention provides a storage case for a makeup set or cosmetic article, wherein the storage case includes an outer tubular case equipped with a lid or cover on its front end side, an inner tubular case to which a makeup set or cosmetic article may be attached and that is housed in the outer tubular case, and an intermediate tubular case slidably mounted between the outer tubular case and inner tubular case. In the storage case according to the present invention, the intermediate tubular case and the inner tubular case are designed so that they can be locked to the outer tubular case, respectively, and so that they can be moved slidably within the outer tubular case, one followed by the other, thereby solving the problems associated with the prior art storage cases described above.

More specifically, the present invention provides a storage case for a makeup set or cosmetic article, wherein the storage case includes an outer tubular case that is equipped with a lid or cover on its front end side, an intermediate tubular case that may be mounted inside the outer tubular case so that the former can be moved slidably within the latter, and an inner tubular case to which a particular makeup set or cosmetic article may be attached and that may be mounted inside the intermediate tubular case so that the former can be moved slidably within the latter. Each of the inner tubular case and intermediate tubular case has a locking mechanism through which each can be locked to the outer tubular case. There is an engaging/disengaging means between the inner and intermediate tubular cases that permits those two cases to engage each other or disengage from each other. Specifically, the locking mechanism for the intermediate tubular case includes a projection that cooperates with any of the engaging recesses on the outer tubular case and can disengageably engage the appropriate engaging recess. The locking mechanism for the inner tubular case includes an operating member that cooperates with any of the engaging recesses on the outer tubular case and can disengageably engage the appropriate engaging recess. The engaging/disengaging means that is provided between the inner and intermediate tubular cases includes a bearing portion on the intermediate tubular case and a rising member on the inner tubular case that may engage the bearing portion.

The outer tubular case equipped with the lid or cover constitutes the outermost part of the makeup set or cosmetics storage case according to the present invention.

Specifically, the outer tubular case is formed like a cylindrical case extending longitudinally of the storage case and that is open at one end thereof, and has a longitudinal slit through which the operating member on the inner tubular case may be projected so that it can be moved forward and backward along the longitudinal slit. The longitudinal slit starts on the rear side of the outer tubular case, terminating on the front side, and has a plurality of engaging recesses that may engage the locking mechanism on the inner tubular case, and a plurality of engaging recesses that may engage the locking mechanism on the intermediate tubular case.

In the following description, the phrase "the front side of the storage case" should be understood to mean "the open end side of the outer tubular case".

The lid or cover (which will be referred to as the "lid") is mounted to the open end of the outer tubular case so that it can automatically close the outer tubular case when the makeup set or cosmetic article is moved back into the storage case. The makeup set or cosmetic article may be projected out of the storage case or moved back into the storage case through the open end of the outer tubular case where the lid is mounted. The lid may be forced open by the intermediate tubular case inside the outer tubular case when the intermediate tubular case is slid out of the outer tubular case, and may be closed when the intermediate tubular case is slid back into the outer tubular case.

The intermediate tubular case serves as a housing in which a facial brush including its tip portion, any other makeup set or cosmetic article may be held. If such makeup set or cosmetic article is directly held in the outer tubular case, it may stain the exterior of the outer tubular case when it is moved back into the outer tubular case. The intermediate tubular case is provided to avoid such situation since it allows the makeup set or cosmetic article to be moved back into the outer tubular case with the makeup set or cosmetic being held within the intermediate tubular case.

The intermediate tubular case is also mounted slidably inside the outer tubular case so that it can force the lid to open when it is moved toward the open end of the outer tubular case where the lid is mounted. The head of the intermediate tubular case may have any form that allows it to open the lid 2 smoothly when the head hits the lid. For example, in cases where the lid is mounted to the outer tubular case by means of a spring 7 as shown in FIG. 2(*b*), the lid could not be opened smoothly if the head of the intermediate tubular case would have the form such that the head would first hit the side of the lid where the spring 7 is mounted when the intermediate tubular case is moved toward the lid. For this reason, the head of the intermediate tubular case should be formed such that the head could first hit the side 2*a* of the lid opposite the side on which the spring 7 is mounted. This would permit the lid to be opened smoothly when the head hits the lid.

The intermediate tubular case may be configured to include a holding portion for accepting the inner tubular case therein and an engaging portion adjoining the holding portion and that may engage the inner side of the wall of the inner tubular case.

The holding portion has a cross sectional shape that conforms to that of the outer tubular case, and may be located on the open end side (front side) of the outer tubular case where the lid is mounted when the inner tubular case is mounted inside the outer tubular case.

The engaging portion includes a lower plate and an upper plate that are provided for adjoining the rear side of the holding portion. The upper plate may be made of an elastic plate. The distance between the lower plate and upper plate should be such that the lower plate and upper plate can engage the inner sides of the corresponding upper and lower walls of the outer tubular case, and should become larger from the point where the lower and upper plates are mounted to the holding portion toward the rear ends of the lower and upper plates. The distance as measured vertically between the lower and upper plates at the ends thereof should be larger than the distance as measured vertically between the inner sides of the upper and lower walls of the outer tubular case.

The intermediate tubular case has a longitudinal slit that extends from the holding portion toward the upper plate, and an operating member on the inner tubular case may be projected through the longitudinal slit so that it can be moved longitudinally along the slit. The rear end of the upper plate may serve as a bearing portion that allows the rear end of the upper member of the inner tubular case to ride slightly onto the bearing portion.

The lower plate has a longitudinal slit that extends centrally from the lower wall of the holding portion, through which the lower member of the inner tubular case can engage the inner side of the lower wall of the outer tubular case as described later, when the inner tubular case is mounted inside the intermediate tubular case.

The engaging portion may have a projection that forms part of the locking mechanism for the intermediate tubular case.

The intermediate tubular case that has been described above may be mounted slidably inside the outer tubular case by inserting the intermediate tubular case into the outer tubular case, with the lower and upper plates of the engaging portion being brought closer to each other, and then by causing the engaging portion to engage the inner sides of the upper and lower walls of the outer tubular case.

The inner tubular case may be configured to include a mounting portion within which a makeup set or a cosmetic article such as a lipstick may be mounted securely, and an upper member and a lower member that are provided for adjoining the rear end of the mounting portion.

The upper member may have its underside on the rear side that is slanted downwardly from the rear end toward the front end, and may have an operating member that forms part of the locking mechanism for the inner tubular case and that may be used to operate the inner and intermediate tubular cases for the sliding movement inside the outer tubular case. The operating member may have a projection that can disengageably engage any of the engaging recesses on the outer tubular case.

The upper member may be a flexible plate that may be made of any elastic material.

On the other hand, the lower member may have a rising member on the rear side that extends upwardly from its rear end toward the rear end of the upper member. As shown in FIG. 10, the distance W1 between the forward or free end of the rising member and the rear end of the upper member should be larger than the width W2 of the bearing portion of the upper plate on the intermediate tubular case that is located at the rear end thereof, so that the bearing portion can be moved up and down through the space between the forward end of the rising member and the rear end of the upper member.

The inner tubular case constructed as described above may be mounted inside the intermediate tubular case in the following sequence. That is, the upper member on the inner tubular case may be made to project through the longitudinal slit that extends over the upper plate of the intermediate tubular case, starting on the location of the holding portion thereof, so that it can engage the inner side of the upper wall of the outer tubular case, while the lower member on the inner tubular case may be made to project through the longitudinal slit extending over the center of the lower plate of the intermediate tubular case, so that it can engage the inner side of the lower wall of the outer tubular case. Thus, the inner tubular case may be mounted inside the intermediate tubular case so that it can be moved slidably therein.

The locking mechanism on the intermediate tubular case is provided for locking the intermediate tubular case to the outer tubular case. It includes a plurality of engaging recesses provided on the outer tubular case and a projection provided on the intermediate tubular case that can disengageably engage any of the engaging recesses. The engaging recesses on the outer tubular case may include a first engaging recess that is provided at the beginning of the longitudinal slit on the outer tubular case and a second engaging recess that is provided on the middle point of the longitudinal slit.

As described, the intermediate tubular case may be mounted slidably inside the outer tubular case by inserting the intermediate tubular case into the outer tubular case, with the lower and upper members of the engaging portion being brought closer to each other, and then by bringing the lower and upper members into engagement with the inner sides of the corresponding upper and lower walls of the outer tubular case. Then, by sliding the intermediate tubular case inside the outer tubular case so that the appropriate engaging recess on the outer tubular case can register with the projection on the intermediate tubular case, the projection may be raised toward the engaging recess by the elastic action of the upper plate, and can engage the engaging recess. The intermediate tubular case can thus be locked to the outer tubular case.

It may be appreciated from the above description that when a makeup set or cosmetic article is stored in the storage case, the projection on the intermediate tubular case may engage the first engaging recess that is located at the beginning of the longitudinal slit on the outer tubular case, while when the makeup set or cosmetic article is projected out of the storage case, the projection on the intermediate tubular case may engage the second engaging recess that is located on the middle point of the longitudinal slit on the outer tubular case. Thus, the intermediate tubular case may be locked to the outer tubular case in the respective positions where the projection engages the respective engaging recesses.

The locking mechanism on the inner tubular case is provided for locking the inner tubular case to the outer tubular case, and includes an engaging recess on the outer tubular case and an operating member on the inner tubular case that can disengageably engage the engaging recess. Preferably, the operating member may have a projection that can disengageably engage the engaging recess on the outer tubular case. The engaging recess on the outer tubular case may include a third engaging recess that is located at the beginning of the longitudinal slit on the outer tubular case and a fourth engaging recess that is located at the end of the longitudinal slit.

As described above, the inner tubular case may be mounted slidably inside the intermediate tubular case by causing its upper member to project through the longitudinal slit on the intermediate tubular case that starts from the location of the holding portion of the intermediate tubular case and extends over the upper plate of the intermediate tubular case, and then causing the upper member to engage the inner wall of the upper side of the outer tubular case, while at the same time by causing its lower member to project through the longitudinal slit on the intermediate tubular case that extends through the lower plate of the intermediate tubular case, and then by causing the lower member to engage the inner wall of the lower side of the outer tubular case. Then, by sliding the inner tubular case inside the intermediate tubular case so that the operator member or its projection can register with the engaging recess on the outer tubular case, the upper member that has been pressed down by the operator member or its projection may be released from the down pressure of the operator member, returning to its original position. This may cause the operator member or its projection to be raised toward the engaging recess so that it can engage the engaging recess. Thus, the inner tubular case may be locked to the outer tubular case.

The engaging/disengaging means that engages the inner and intermediate tubular cases disengageably may include, for one part, a bearing portion on the intermediate tubular case, and, for the other part, a rising member on the inner tubular case that may engage the bearing portion. This engaging/disengaging means may cause both of the intermediate tubular case and inner tubular case or only the inner tubular case to slide, depending upon how the two cases are engaged or disengaged.

The bearing portion has its upper side that may engage the lower side on the rear end of the upper member of the inner tubular case, allowing the rear end of the upper member slightly to ride onto the bearing portion. Then, pressing the operator member down may cause the bearing portion to be moved down together with the upper member. In addition, the bearing portion has its rear end that may be supported by the front end of the rising member. As the bearing portion is constructed as described above, it can engage the inner and intermediate tubular cases.

In accordance with the storage case for a makeup set such as a facial brush or a cosmetic article such as a lipstick that has been described so far, the lid may be opened or closed simply by moving the operating member 13 forth and back, in order to allow the makeup set or cosmetic article to be moved out of or back into the storage case. This avoids the facial brush or cosmetic article staining other parts of the storage case by making contact with those other parts. It may be appreciated that the present invention is particularly advantageous in that all operations may be performed by a single hand, and the storage case may be used in a convenient, easy way.

BRIEF DESCRIPTION OF THE DRAWINGS

FIG. 2(*b*) is a perspective view of the lid or cover for the storage case of FIG. 1, showing, on an enlarged scale, how the lid or cover may be mounted on the storage case;

FIG. 5(*b*) is a perspective view of the intermediate case forming part of the storage case of FIG. 1;

FIG. 5(*c*) is a perspective view of the outer tubular case forming part of the storage case of FIG. 1;

FIG. 6(*b*) shows the details of the bearing portion and rising member in the inner tubular case, and shows how the bearing portion is to be disengaged from the rising member when the operator member is being raised;

FIG. 6(*c*) shows the details of the bearing portion and rising member in the inner tubular case, and shows how the bearing portion is to be engaged by the rising member when the operator member is being moved down;

FIG. 7(*b*) is a front view of the inner tubular case according to a further embodiment of the present invention;

FIG. 7(*c*) is a front view of the intermediate tubular case according to another embodiment of the present invention;

FIG. 9(*b*) is a state diagram that illustrates how the operating member is depressed when the upper member of the inner tubular case is placed onto the bearing portion of the intermediate tubular case;

FIG. 9(*c*) is a state diagram that illustrates how the upper member of the inner tubular case is disengaged from the bearing portion of the intermediate tubular case;

FIG. 9(*d*) is a state diagram that illustrates how the rising member of the inner tubular case engages the rear end of the bearing portion of the intermediate tubular case;

FIG. 9(*e*) is a state diagram that illustrates how the rising member of the inner tubular case is passed below the bearing portion of the intermediate tubular case.

BEST MODES OF EMBODYING THE INVENTION

Now, several preferred embodiments of the present invention are described by referring to the accompanying drawings.

Figure 1:
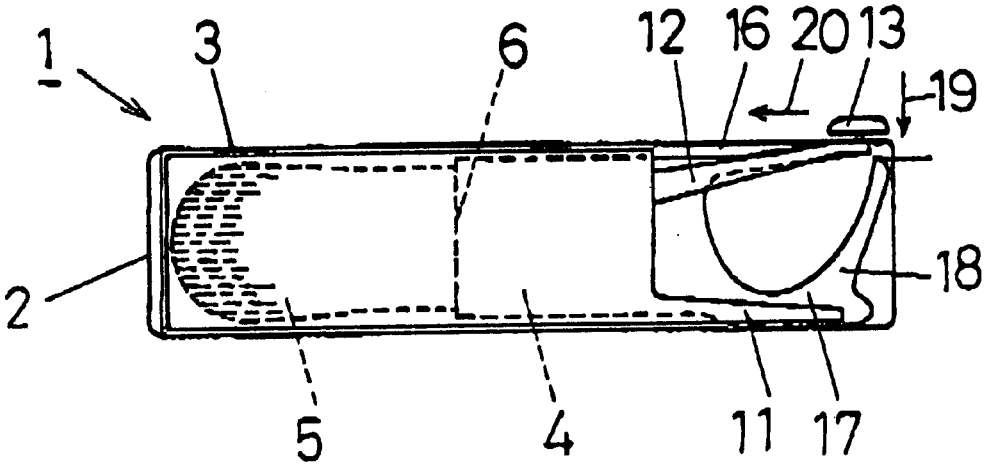
FIG. 1 is a front view of the storage case according to one embodiment of the present invention, with some parts being shown in cross section.

Referring first to FIG. 1, a storage case, which is generally represented by 1, includes an outer tubular case 3 equipped with a lid or cover 2, an intermediate tubular case 4 slidably mounted within the outer tubular case 3, and an inner tubular case 6 slidably mounted within the intermediate tubular case 4. As shown in FIG. 1, there is a facial brush or simply a brush 5, for example, which is attached to the front end side of the inner tubular case G. Each of the inner tubular case 6 and intermediate tubular case 4 has a locking mechanism through which each can be locked to the outer tubular case 3. The inner tubular case 6 and the intermediate tubular case 4 may also disengageably engage each other through an engaging/disengaging means disposed between the inner and intermediate tubular cases 6 and 4.

Figure 5:
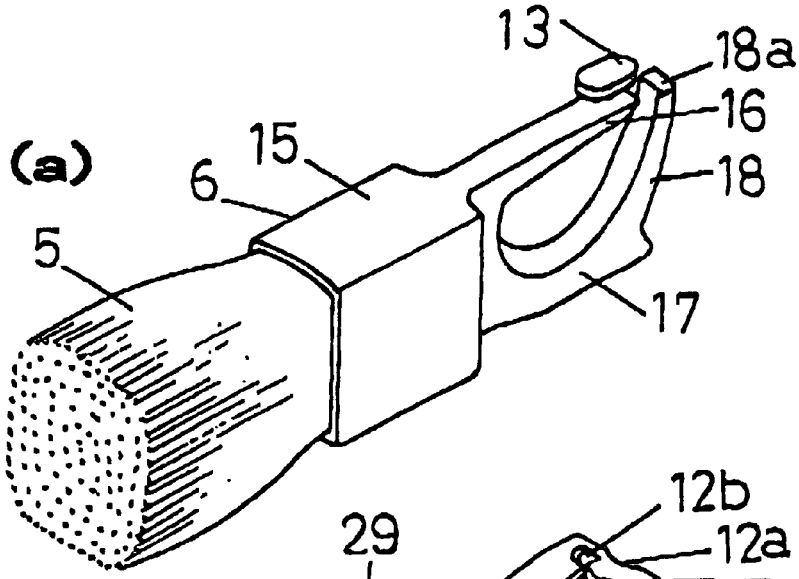
FIG. 5(*a*) is a perspective view of the inner tubular case forming part of the storage case of FIG. 1.
Figure 5:
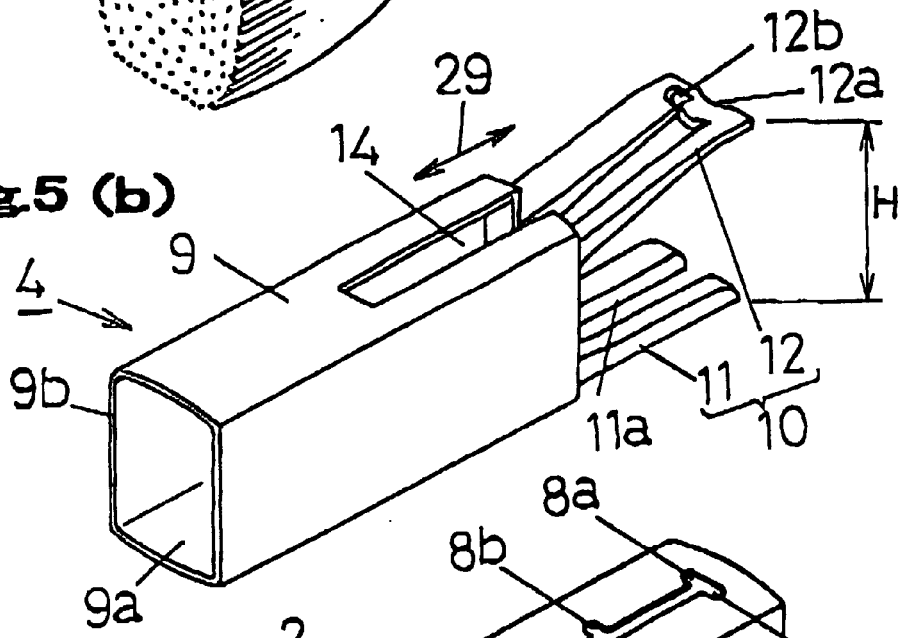
Figure 5:
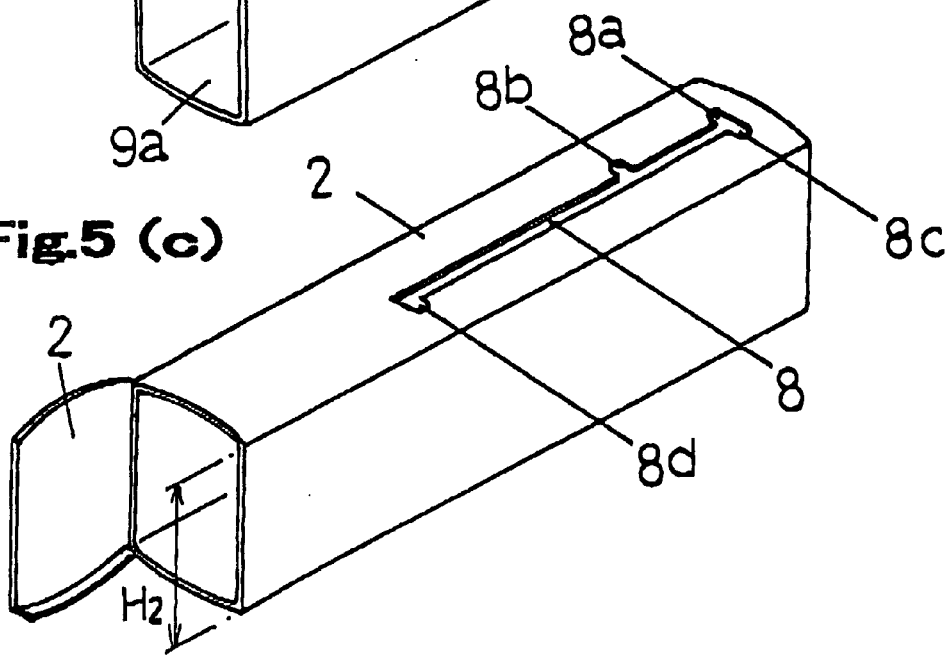

It may be seen from FIG. 5(*c*) that the outer tubular case 3 has an elongated cylindrical form having a square cross section, and is open at one end. The open end of the outer tubular case 3 is normally closed by a lid or cover 2 that is urged by a spring 7 (FIG. 2(*b*)) toward its closed position. The lid or cover 2, which will be referred to as the lid 2, may be opened against the action of the spring 7. The outer tubular case 3 has a longitudinal slit 8 on its upper side that extends longitudinally in parallel with the center line of the outer tubular case 3. As shown in FIG. 5(*c*), the longitudinal slit 8 has its terminating end located on the open end side (front side) of the outer tubular case 3, and its starting end located on the side (rear side) opposite the open end side. Furthermore, the longitudinal slit 8 has a first engaging recess 8*a* and a third engaging recess 8*con its starting end side, a second engaging recess 8*b* on its middle portion, and a fourth engaging recess 8*d* on its terminating end side (FIG. 5(*c*)).

As seen from FIG. 5(*b*), the intermediate tubular case 4 includes a holding portion 9 that has a cylindrical form and in which the inner tubular case 6 may be accepted, and an engaging portion 10 that adjoins the rear side of the holding portion 9. The engaging portion 10 may be made to engage the inner walls of the upper and lower sides of the outer tubular case 3.

The holding portion 9 has a square cross section that is analogous to that of the outer tubular case 3. The open end of the holding portion 9 is formed such that its end edge 9*b*, which is located on the side of the outer tubular case 3 on which the lid 2 is hinged, can make contact with the lid 2 earlier than the end edge 9*a* opposite the end edge 9*b* when the intermediate tubular case 4 is mounted inside the outer tubular case 3.

The engaging portion 10 includes an upper plate 12 and a lower plate 11 that adjoin the rear end of the holding portion 9. The upper plate 12 may be made of an elastic plate.

Figure 3:
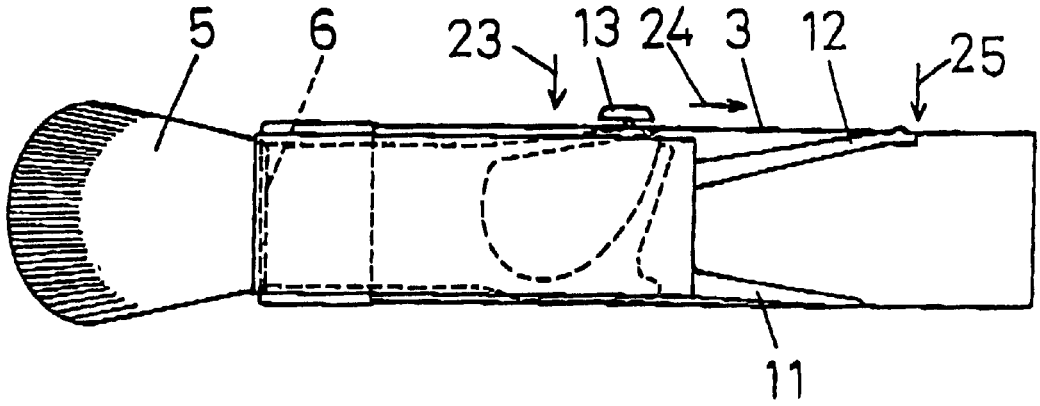
FIG. 3 is a front view of the storage case of FIG. 1, with the facial brush being pushed out of the storage case and with some parts shown in cross section.

The holding portion 9 has a longitudinal slit 14 on its upper side, as shown in FIG. 5(*b*). An operating member 13 that is provided on the inner tubular case 6 (FIG. 5(*a*)) may be accepted by the longitudinal slit 14, through which the operating member 13 may be projected, and may be moving in the longitudinal direction as shown by a double arrow 29 in FIG. 5(*b*), when the inner tubular case 6 that is slidably mounted inside the intermediate tubular case 4 as shown in FIG. 1 is moving in the respective directions shown by an arrow 20 (FIG. 1) and an arrow 24 (FIG. 3).

The holding portion 9 also has a longitudinal slit (not shown) on its lower side that is provided on the location corresponding to that of the longitudinal slit 14 on the upper side. This longitudinal slit (not shown) adjoins a slit 11*a* extending longitudinally along the center of the lower plate 11. The longitudinal slit (not shown) and the longitudinal slit 11*a* are provided to allow the lower member 17 (FIG. 5(*a*)) on the inner tubular case 6 to be moving in the longitudinal direction shown by the double arrow 29 in FIG. 5(*b*), when the inner tubular case 6 that is slidably mounted inside the intermediate tubular case 4 is moving in the respective directions shown by the arrow 20 (FIG. 1) and the arrow 24 (FIG. 3).

The upper plate 12 has a bearing portion 12*a* at its rear end. As shown in FIG. 5(*b*), this bearing portion 12*a* has a projection 12*b* on the lateral side thereof that will face opposite the lateral side of the longitudinal slit 8 on which the first engaging recess 8*a* and second engaging recess 8*b* are located, when the intermediate tubular case 4 is mounted inside the outer tubular case 3.

The distance as measured vertically between the lower plate 11 and upper plate 12 becomes larger toward the rear end, starting with the point where those plates are mounted to the holding portion 9. The height H1 of the engaging portion 10, that is, the distance as measured vertically between the lower and upper plates 11, 12 on the rear ends thereof, is larger than the height or distance H2 as measured vertically between the upper and lower inner walls of the outer tubular case 3 (FIG. 5(*c*)).

The intermediate tubular case 4 that has been constructed as described above may be mounted slidably inside the outer tubular case 3 by inserting the intermediate tubular case 4 into the outer tubular case 3 with the holding portion 9 being placed on the open end side of the outer tubular case 3 and with the distance between the lower and upper plates 11, 12 of the engaging portion 10 being reduced to be smaller than the height H2 between the upper and lower walls of the outer tubular case 3. When the intermediate tubular case 4 is thus mounted inside the outer tubular case 3, the engaging portion 10 may be brought into engagement with the inner walls of the upper and lower sides of the outer tubular case 3 by the elastic action of the upper plate 12.

The inner tubular case 6 includes a mounting portion 15 on its front end side in which a facial brush 5, for example, may be accepted and secured, and an upper member 16 and a lower member 17 that adjoin the rear end of the mounting portion 15. The upper member 16 has the form of a plate that may be made of any flexible or elastic material.

Figure 9:
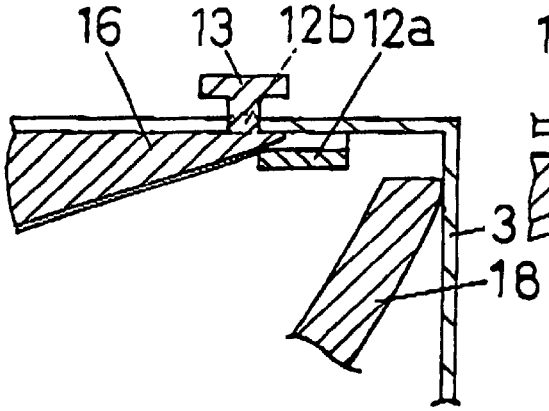
FIG. 9(*a*) is a state diagram that illustrates how the upper member of the inner tubular case is placed onto the bearing portion of the intermediate tubular case.
Figure 9:
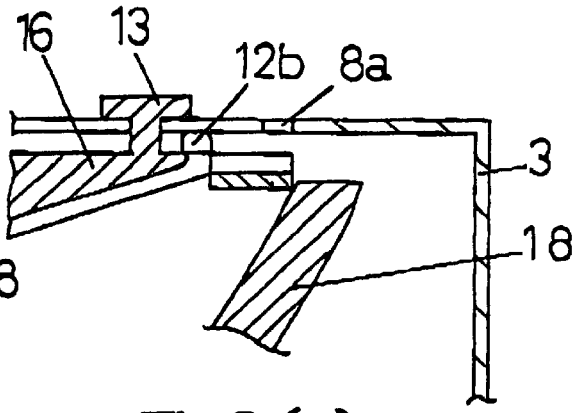
Figure 9:
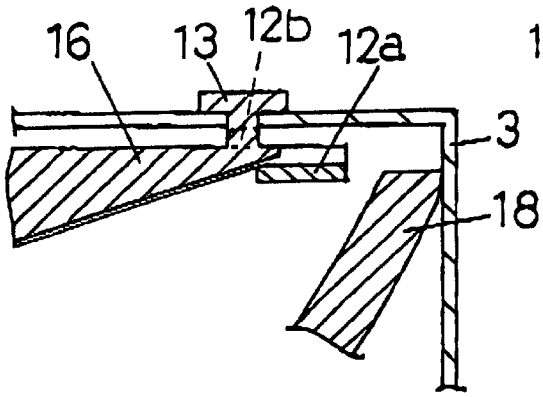
Figure 9:
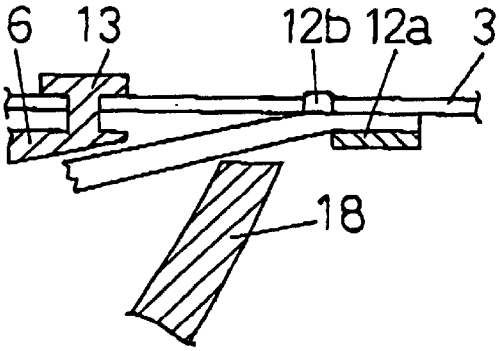
Figure 9:
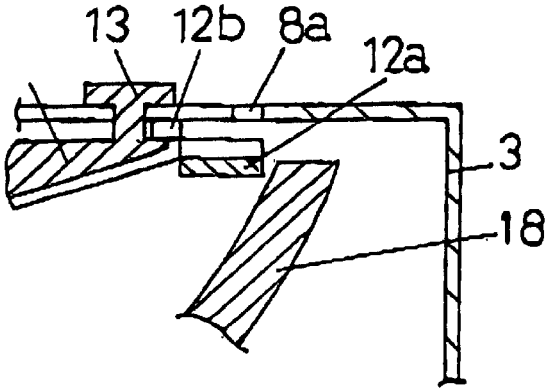
Figure 10:
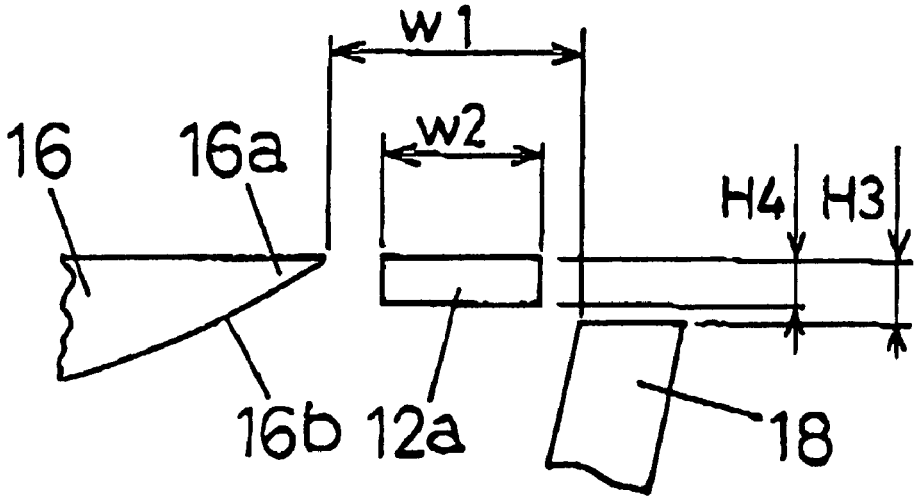
FIG. 10 is a conceptual diagram that illustrates how the distance W1 between the front end of the rising member and the rear end of the upper member is related to the width W2 of the bearing portion.

As seen from FIG. 9(*a*) and FIG. 10, the upper member 16 has its underside 16*b* on the rear end side slanted downwardly from the rear end toward the front end where the mounting portion 15 is located. The upper member 16 has an operating member 13 on its upper side. The operating member 13 may have a projection 13*a* on the side thereof that will face opposite the side of the outer tubular case 3 on which the third engaging recess 8*c* is located when the inner tubular case 4 is mounted inside the intermediate tubular case 4 that is mounted inside the outer tubular case 3 (FIG. 6(*a*)).

The lower member 17 has a rising member 18 on its rear end side that may be raised toward the rear end side of the upper member 16 (FIG. 5(*a*)). It may be seen from FIG. 10 that the distance W1 between the forward end 18*a* of the rising member 18 and the rear end 16*a* of the upper member 16 is such that it should be larger than the width W2 of the bearing portion 12*a* that is located on the rear end of the upper plate 12 of the intermediate tubular case 4.

The position in which the forward end 18*a* of the rising member 18 is placed in the vertical position is such that the distance H3 between the upper side of the upper member 16 on the inner tubular case 6 and the upper side of the forward end 18*a* of the rising member 18 should be at least larger than the width H4 of the bearing portion 12*a* when the inner tubular case 6 is locked to the outer tubular case 3 inside which the inner tubular case 6 is mounted and when the intermediate tubular case 4 is locked to the outer tubular case 3 inside which the intermediate tubular case 4 is mounted, as shown in FIG. 1 and FIG. 9(*a*) respectively.

Figure 2:
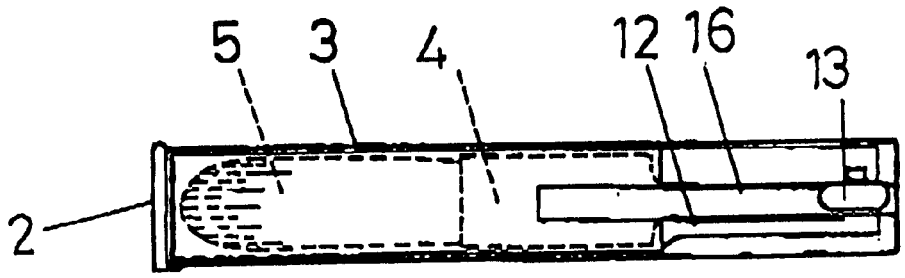
FIG. 2(*a*) is a plan view of the storage case of FIG. 1, with some parts being shown in cross section.
Figure 2:
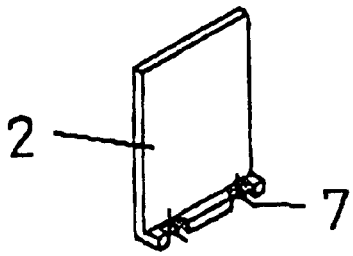

The inner tubular case 6 that may be constructed as described above may be mounted slidably within the intermediate tubular case 4 by allowing the operating member 13 on the upper member 16 to project through the longitudinal slit 14 on the intermediate tubular case 4 and a slit 11*a* extending longitudinally along the center of the lower plate 11 in order to cause the upper side of the upper member 16 to engage the inner wall of the upper side of the outer tubular case 3. The lower member 17 to project through the longitudinal slit (not shown) on the lower wall of the holding portion 9 on the intermediate tubular case 4 in order to cause the lower member 17 to engage the inner wall of the lower side of the outer tubular case 3 (FIGS. 1 and 2).

A locking mechanism that may be provided to permit the intermediate tubular case 4 to be locked to the outer tubular case 3 includes a first engaging recess 8*a* and a second engaging recess 8*b* on the outer tubular case 3 and the projection 12*b* on the intermediate tubular case 4 that may disengageably engage the first and second engaging recesses 8*a*, 8*b*.

A locking mechanism that may be provided to permit the inner tubular case 6 to be locked to the outer tubular case 3 includes a third engaging recess 8*c* and a fourth engaging recess 8*d* on the outer tubular case 3, and a projection 13*a* on the operating member 13 that may disengageably engage the third and fourth engaging recesses 8*c*, 8*d*.

An engaging/disengaging means that may be provided to permit the inner tubular case 6 to disengageably engage the intermediate tubular case 4 is constructed as described below.

When the inner tubular case 6 is locked to the outer tubular case 3 inside which the inner tubular case 6 is mounted and when the intermediate tubular case 4 is locked to the outer tubular case 3 inside which the intermediate tubular case 4 is mounted, as shown in FIG. 1, the engaging/disengaging means allows the upper side of the bearing portion 12*a* of the upper plate 12 on the intermediate tubular case 4 to engage the lower end 16*b* on the rear end side of the upper member 16 on the inner tubular case 6 (FIG. 9(*a*)). It may be seen from FIG. 9(*a*) and FIG. 10 that the lower end 16*b* on the rear end side of the upper member 16 is slanted downwardly from the rear end toward the front end, and the upper side of the bearing portion 12*a* of the upper plate 12 on the intermediate tubular case 4 is formed to accept the lower slanted end 16*b*. When the inner and intermediate tubular cases 6, 4 are locked to the outer tubular case 3, the projection 13*a* on the operating member 13 of the upper member 16 on the inner tubular case 6 and the projection 12*b* of the bearing portion 12*a* are placed at substantially the same vertical height, where the projection 13*a* and the projection 12*b* engage the third engaging recess 8*c* and first engaging recess 8*a* provided on the longitudinal slit 8 of the outer tubular case 3, respectively. It should be noted that it does not matter whether the inner and intermediate tubular cases 6, 4 engage each other or not at this time, since the inner tubular case 6 is now locked to the outer tubular case 3 and the intermediate tubular case 6 may also be locked to the outer tubular case 3.

When the operating member 13 on the inner tubular case 6 is pushed down (in the direction of an arrow 19 in FIG. 1) against the elastic action of the upper plate 12 on the intermediate tubular case 4, the bearing portion 12*a* on the upper plate 12 on the intermediate tubular case 4 may also be pushed down by the lower end 16*b* on the rear end side of the upper member 16 on the inner tubular case 6. Thus, the projection 13*a* on the inner tubular case 6 and the projection 12*b* on the bearing portion 12*a* that now engage the corresponding third engaging recess 8*c* and first engaging recess 8*a*, respectively, may be disengaged from those engaging recesses at the same time (FIG. 9(*b*)).

Then, applying force to the operating member 13 to urge it to move forwardly (in the direction of an arrow 20 in FIG. 1) may cause both the inner tubular case 6 and the intermediate tubular case 4 to move forwardly by a slight distance, under the frictional action of the lower end 16*b* on the rear end side of the upper member 16 on the inner tubular case 6 and the upper side of the bearing portion 12*a* of the upper plate 12 on the intermediate tubular case 4 that engage each other.

When the inner tubular case 6 and intermediate tubular case 4 are thus moved forwardly by a slight distance, the projection 12*b* and projection 13*a* may be placed below the upper wall of the outer tubular case 3, respectively, so that they can engage the inner side of the upper wall. Thus, those projections 12*b* and 13*a* may be prevented from being raised toward the corresponding first engaging recess 8*a* and third engaging recess 8*c*.

Then, when the operating member 13 is moved further forwardly, only the inner tubular case 6 may begin moving forwardly. Thus, the lower end 16*b* on the rear end side of the upper member 16 on the inner tubular case 6 and the upper side of the bearing portion 12*a* of the upper plate 12 on the intermediate tubular case 4, which now engage each other, may be disengaged from each other (FIG. 9(*c*)).

When only the inner tubular case 6 begins to move forwardly (in the direction of the arrow 20 in FIG. 1), the rear end side of the bearing portion 12*a* may engage the front side of the rising member 18 on the inner tubular case 6. Then, force may be applied to the rear end side of the bearing portion 12*a* on the intermediate tubular case 4, which may also urge the intermediate tubular case 4 to begin moving forwardly (in the direction of the arrow 20 in FIG. 1) together with the inner tubular case 6.

In other words, the inner and intermediate tubular cases 6, 4 may be moving together as they engage each other.

Then, as the inner and intermediate tubular cases 6, 4 are moving forwardly (in the direction of the arrow 20 in FIG. 1), the lid 2, which is located at the open end of the outer tubular case 3 may get ready to be opened by the front end of the intermediate tubular case 4, and the projection 12*b* of the bearing portion 12*a* on the intermediate tubular case 4 may be positioned below the second engaging recess 8*b* provided on the longitudinal slit 8 on the outer tubular case 3. At this time, the entire facial brush 5, including its tip, on the inner tubular case 6 still stays inside the intermediate tubular case 4.

When the projection 12*b* of the bearing portion 12*a* on the intermediate tubular case 4 is just placed below the second engaging recess 8*b* of the longitudinal slit 8 on the outer tubular case 3, it may be projected through the second engaging recess 8*b* of the longitudinal slit 8 by the elastic action of the upper plate 12 on the intermediate tubular case 4. Thus, the projection 12*b* may be made to engage the second engaging recess 8*b*, and the intermediate tubular case 4 may be locked to the outer tubular case 3.

The distance W1 between the forward end 18*a* of the rising member 18 of the lower member 17 on the inner tubular case 6 and the rear end 16*a* of the upper member 16 on the inner tubular case 6, the width W2 of the bearing portion 12*a* on the intermediate tubular case 4, the vertical height of the forward end 18*a* of the rising member 18, and the thickness H4 of the bearing portion 12*a* have the relationship as defined above. Thus, when the projection 12*b* of the bearing portion 12*a* on the intermediate tubular case 4 engages the second engaging recess 8*b* of the longitudinal slit 8 on the outer tubular case 3, the bearing portion 12*a* on the intermediate tubular case 4 may be allowed to pass between the forward end 18*a* of the rising member 18 on the inner tubular case 6 and the rear end 16*a* of the upper member 16, allowing only the inner tubular case 6 to continue to be moving forwardly (in the direction of the arrow 20 in FIG. 1).

The inner and intermediate tubular cases 6, 4, which have engaged each other, may now be disengaged from each other.

Figure 4:
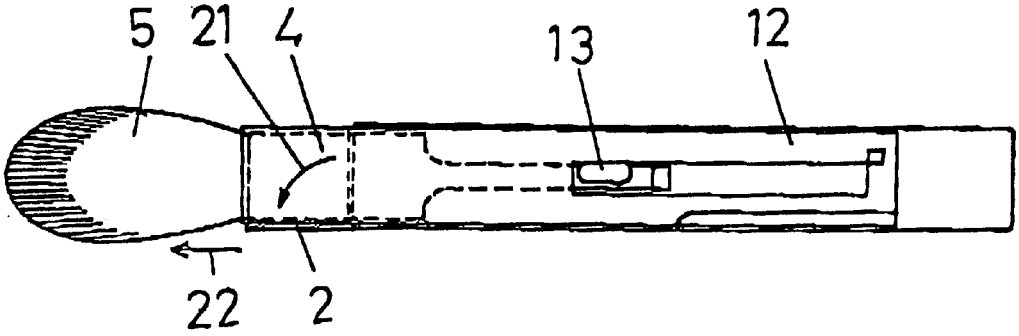
FIG. 4 is a plan view of the storage case of FIG. 3, with some parts being shown in cross section.

As the inner tubular case 6 continues to be moving forwardly (n the direction of the arrow 20 in FIG. 1) until the facial brush 5 is projected through the front open end of the outer tubular case 3 as shown in FIGS. 3 and 4, the operating member 13 may be located at the end of the longitudinal slit 8 on the outer tubular case 3. Then, when the operating member 13 is released from the depression, it may cause the projection 13*a* of the operating member 13 to be projected through the fourth engaging recess 8*d*. Thus, the projection 13*a* may engage the fourth engaging recess 8*d*, and the inner tubular case 6 may be locked to the outer tubular case 3.

Reversely, when the facial brush 5 is to be moved back into the outer tubular case 3, the operating member 13 may be pushed downwardly (in the direction of an arrow 19 in FIG. 1) so that the projection 13*a* that now engages the fourth engaging recess 8*d* may be disengaged from the fourth engaging recess 8*d*. When the projection 13*a* is disengaged from the fourth engaging recess 8*d*, force may then be applied to the operating member 13 that causes the inner tubular case 6 to move backwardly (in the direction of an arrow 24 in FIG. 3).

When the rising member 18 on the lower member 17 of the inner tubular case 6 goes back to the location where the projection 12*b* of the bearing portion 12*a* on the intermediate tubular case 4 now engages the second engaging recess 8*b* of the longitudinal slit 8 on the outer tubular case 3, the bearing portion 12*a* on the intermediate tubular case 4 may be allowed to pass between the forward end 18*a* of the rising member 18 on the inner tubular case 6 and the rear end 16*a* of the upper member 16, going back to the state shown in FIG. 9(*b*) from the state shown in FIG. 9(*e*). This may cause the upper side of the bearing portion 12 to engage the lower side 16*b* on the rear end side of the upper member 16 on the inner tubular case 6, while the projection 12*b* on the intermediate tubular case 4 that now engages the second engaging recess 8*b* may be disengaged from the second engaging recess 8*b*. Thus, the intermediate tubular case 4 may be unlocked from the outer tubular case 3. As described and as shown in FIG. 9(*a*) and FIG. 10, the lower side 16*b* on the rear end side of the upper member 16 on the inner tubular case 6 is slanted downwardly from the rear end toward the front end, and the upper side of the bearing portion 12*a* of the upper plate 12 on the intermediate tubular case 4 also has a form that conforms to the form of the lower side of the upper member 16. This permits the upper side of the bearing portion 12*a* to engage easily the lower side 16*b* on the rear end side of the upper member 16 on the inner tubular case 6.

Then, the intermediate tubular case 4 may be moved backwardly (in the direction of the arrow 24 in FIG. 3) together with the inner tubular case 6, with the upper side of the bearing portion 12*a* engaging the lower side 16*b* on the rear end side of the upper member 16 on the inner tubular case 6.

Then, when the operating member 13 on the inner tubular case 6 is returned to the location where the longitudinal slit 8 on the outer tubular case 3 starts (FIG. 1), the intermediate tubular case 4 may also be brought back to the state as shown in FIG. 9(*a*), in which the inner tubular case 6 may be locked to the outer tubular case 3 and the intermediate tubular case 4 may also be locked to the outer tubular case 3 by the elastic action of the upper plate 12 on the intermediate tubular case 4.

Now, how the storage case 1 described above can be used is described in brief.

In describing how to use the storage case 1, it is assumed that the inner tubular case 6 and the intermediate tubular case 4 are initially locked to the outer tubular case 3. Then, the inner tubular case 6 and intermediate tubular case 4 may be unlocked from the outer tubular case 3, allowing the cases 6, 4 to move forwardly. By moving the inner and intermediate tubular cases 6, 4 forwardly, the lid 2 on the outer tubular case 3 will be opened by the intermediate tubular case 4. When the lid 2 is opened, the intermediate tubular case 4 may be locked to the outer tubular case 3. Then, advancing the inner tubular case 6 further will cause the facial brush 5 to be projected out of the outer tubular case 3. Then, the inner tubular case 6 may be locked to the outer tubular case 3 (FIGS. 3 and 4). In this case, the inner tubular case 6 may be projected through the open end of the outer tubular case 3, with its forward end being located ahead of the tip end of the lid 2. Thus, there is no risk of the inner tubular case 6 hindering the usage of the facial brush 5.

After using the facial brush 5, it may be moved back into the intermediate tubular case 4 by moving the inner tubular case 6 back into the outer tubular case 3. Then, the intermediate tubular case 4 may be unlocked from the outer tubular case 3 to allow both the inner and intermediate tubular cases 6, 4 to be moved backwardly until the cases reach the rear end. Upon reaching the rear end, the two cases may be locked to the outer tubular case 3, respectively. This will conclude one cycle. When the intermediate tubular case 4 reaches the rear end, the lid 2 will be closed automatically by the spring 7 that normally urges the lid 2 toward its closed position.

Figure 8:
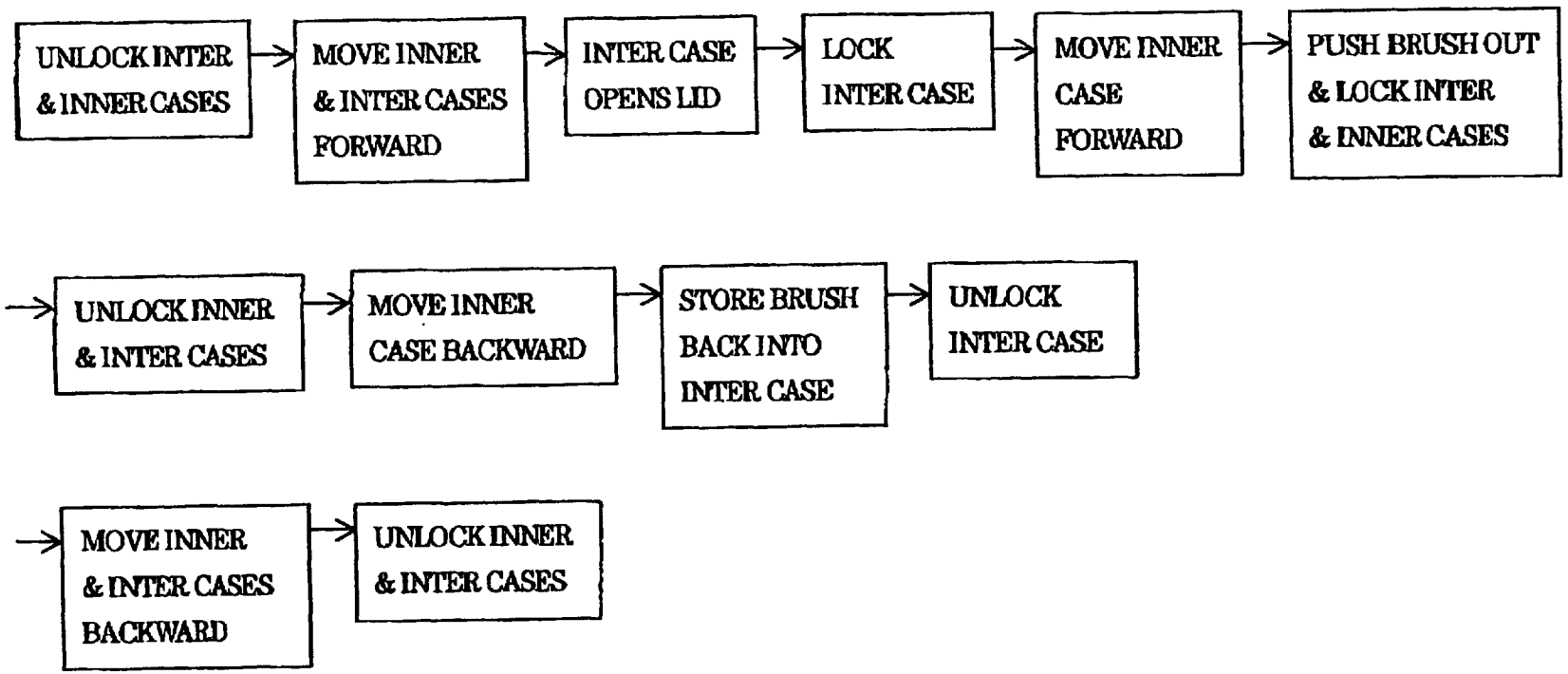
FIG. 8 shows the step-by-step operating procedure that may be performed when the storage case is actually used, in which each step is represented by a block.

FIG. 8 illustrates the step-by-step procedure for operating the storage case 1, each step being represented by a block.

Now, the operations of using the storage case 1 are described more specifically by referring to FIG. 8.

Again, it is assumed that the intermediate tubular case 4 and the inner tubular case 6 are initially placed inside the outer tubular case 3 as shown in FIG. 1, in which the intermediate tubular case 4 is locked to the outer tubular case 3 by having the projection 12*b* of the bearing portion 12*a* engage the first engaging recess 8*a*, and the inner tubular case 6 is locked to the outer tubular case 3 by having the projection 13*a* engage the third engaging recess 8*c*.

Figure 6:
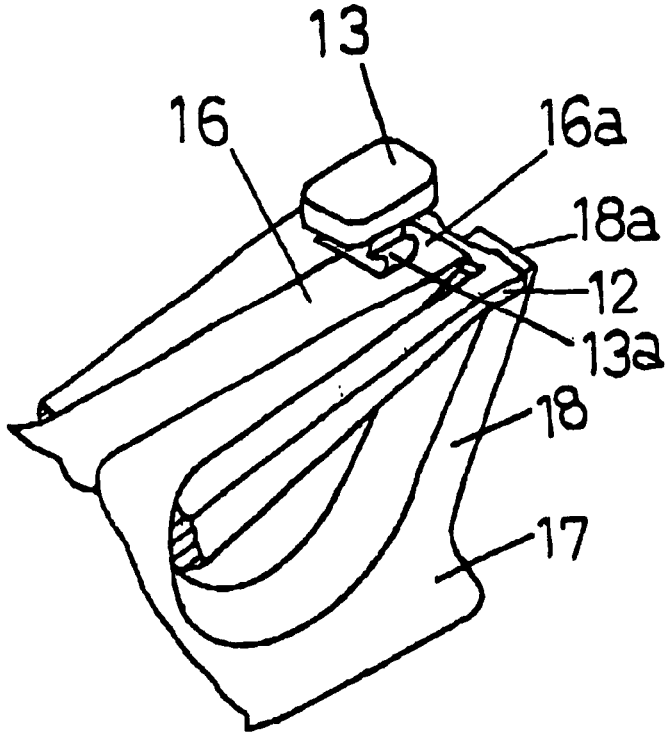
FIG. 6(*a*) shows the details of the upper member and bearing portion in the inner tubular case in a perspective view, and shows how the upper member and bearing portion engage each other.
Figure 6:
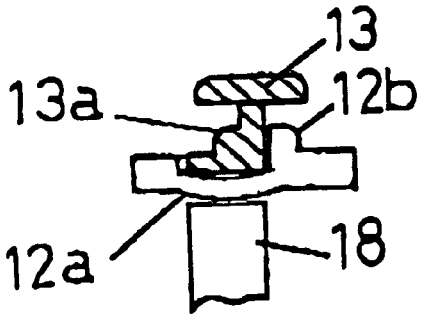
Figure 6:
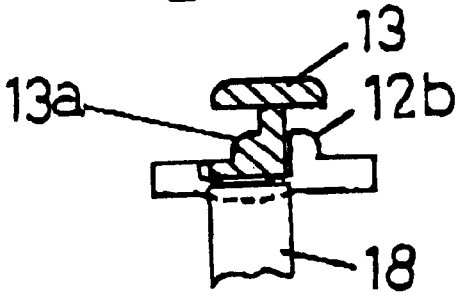

The bearing portion 12*a* and the upper member 16 of the inner tubular case 6 are placed in the state as shown in FIG. 6(*b*) and FIG. 9(*a*) in which the lower end 16*b* on the rear end side of the upper member 16 on the inner tubular case 6 is placed onto the bearing portion 12*a*, with the upper side of the bearing portion 12*a* engaging the lower end 16*b* on the rear end side of the upper member 16 and with the bearing portion 12*a* and the rising member 18 not engaging each other.

When using the facial brush 5, the first step is to depress the operating member 13 in the direction of an arrow 19 to cause the projection 13*a* to be disengaged from the third engaging recess 8*c*. When the projection 13*a* is disengaged from the third engaging recess 8*c*, the upper side of the bearing portion 12*a* remains to engage the lower end 16*b* on the rear end side of the upper member 16. Thus, the upper plate 12 on the intermediate tubular case 4 will also be moved down to cause the projection 12*b* to be disengaged from the first engaging recess 8*a* (FIG. 9(*b*)).

Then, the operating member 13 may be pushed in the direction of the arrow 20. This will cause the inner and intermediate tubular cases 6, 4 to be moved together in the direction of the arrow 20 by the frictional action of the lower end 16*b* on the rear end side of the upper member 16 and the upper side of the bearing portion 12*a* engaging each other.

Those two cases 6, 4 are only moving over a small distance, but the respective projections 12*b* and 13*a* have already been placed below the lower side of the upper wall of the outer tubular case 3 and engaged the lower side of the upper wall, which prevents the projections 12*b*, 13*a* from being raised through the first engaging recess 8*a* and third engaging recess 8*c*, respectively.

Then, when the operating member 13 is pushed further forwardly in the direction of the arrow 20, it will cause the lower end 16*b* on the rear end side of the upper member 16 to be disengaged from the upper side of the bearing portion 12*a* (FIG. 9(*c*)).

After the lower end 16*b* on the rear end side of the upper member 16 has been disengaged from the upper side of the bearing portion 12*a*, only the inner tubular case 6 can be moved forwardly until the rising member 18 comes into engagement with the rear end of the bearing portion 12*a*. The inner and intermediate tubular cases 6 and 4 have now engaged each other (FIG. 9(*d*)).

After the inner and intermediate tubular cases 6 and 4 have engaged each other, the operating member 6 may be operated to push the inner tubular case 6 further forwardly in the direction of the arrow 20, causing the intermediate tubular case 3 to be pushed forwardly by the rising member 18 engaging the rear end of the bearing portion 12*a* and move forwardly in the direction of the arrow 20 together with the inner tubular case 6.

When the intermediate tubular case 4 is then moved forwardly in the direction of the arrow 20, its head will hit the lid 2, forcing the lid 2 to be opened as shown by an arrow 21.

When the intermediate tubular case 4 is then moved up to the position in which the lid 2 can be opened fully, the projection 12*b* will have been located below the second engaging recess 8*b*. As the rear end 16*a* of the upper member 16 on the inner tubular case 6 is not placed onto the bearing portion 12*a*, the projection 12*b* may be aligned with the second engaging recess 8*b* so that it can be raised through the second engaging recess 8*b*. Thus, the inner tubular case 6 may be disengaged from the intermediate tubular case 4, which may then be locked to the outer tubular case 3.

When the inner tubular case 6 is disengaged from the intermediate tubular case 4, this will prevent the rear end of the bearing portion 12*a* from engaging the forward end 18*a* of the rising member 18. Thus, the rising member 18 will be allowed to pass below the bearing portion 12*a*. After then, only the inner tubular case 6 can be moved in the direction of the arrow 20.

As the inner tubular case 6 is moving forwardly in the direction of the arrow 20, it may cause the facial brush 5 to be projected out of the intermediate tubular case 4 as shown by an arrow 22.

When the inner tubular case 6 is moved up to the point where the facial brush 5 may be projected out of the intermediate tubular case 4, the projection 13*a* will have been placed below the fourth engaging recess 8*d*. When the projection 13*a* is placed below the fourth engaging recess 8*d*, the upper member 16, which is flexible, may cause the projection 13*a* to be raised toward the fourth engaging recess 8*d*. Then, the inner tubular case 6 may be locked to the outer tubular case 3 by causing the projection 13*a* to engage the fourth engaging recess 8*d*.

By now, the facial brush 5 gets ready for use. The facial brush 5 may be used with stability, because it is mounted securely inside the mounting portion 15 of the inner tubular case 6 that is locked to the outer tubular case 3 as described above (FIGS. 3 and 4).

After using the facial brush 5, it may be moved back into the storage case 1. This may be accomplished by firstly pushing the operating member 13 downwardly in the direction of an arrow 23 to allow the projection 13*a* to be disengaged from the fourth engaging recess 8*d*, and then moving the operating member 13 in the direction of an arrow 24 to allow the projection 13*a* to re-enter the outer tubular case 3, causing the inner tubular case 6 to move in the direction of an arrow 24. As the inner tubular case 6 is moving with the projection 12*b* remaining to be engaged by the second engaging recess 8*d*, the facial brush 5 can be entirely moved back into the storage case 1, without any risk of causing the intermediate tubular case 4 to slide together with the inner tubular case 6.

When the inner tubular case 6 has moved back as far as the facial brush 5 can entirely be accommodated within the intermediate tubular case 4, the rear end 16*a* of the upper member 16 will make contact with the bearing portion 12*a*, and will then move onto the bearing portion 12*a* because the upper member 16 has the lower end 16*b* on its rear end side formed to be slanted downwardly from the rear end toward the front end, and the bearing portion 12*a* of the upper plate 12 on the intermediate tubular case 4 has the upper side formed to conform to the rear end 16*b* as shown in FIG. 9(*a*) and FIG. 10. Thus, the upper plate 12 may be pushed downwardly in the direction of an arrow 25, permitting the projection 12*b* to be disengaged from the second engaging recess 8*b*.

When the projection 12*b* has been disengaged from the second engaging recess 8*b*, the bearing portion 12*a* may be pressed by the upper member 16, causing the intermediate tubular case 4 to move in the direction of an arrow 14 and back into the outer tubular case 3 (FIG. 9(*a*)).

When the intermediate tubular case 4 has almost moved back into the outer tubular case 3, the projection 12*b* will have been moved below the first engaging recess 8*a* and third engaging recess 8*c*. Then, the projection 12*b* may be raised toward the first engaging recess 8*a* by the upper member 12 that is flexible, where the projection 12*b* may be brought into engagement with the first engaging recess 8*a*. Thus, the intermediate tubular case 4 may be locked to the outer tubular case 3.

In the meantime, the projection 13*a* on the inner tubular case 6 will also have moved below the third engaging recess 8*c*. Then, the projection 13*a* may be toward the third engaging recess 8*c* by the upper plate 16 that is flexible, where the projection 13*a* may be brought into engagement with the third engaging recess 8*c*. Thus, the inner tubular case 6 may be locked to the outer tubular case 3.

When the intermediate tubular case 4 has completely moved into the outer tubular case 3, the lid 2, which is normally urged by the spring 7 toward its closed position, may be closed automatically.

The storage case 1 may be restored to its original state (FIG. 1) after it has gone through the sequence as described above.

Figure 7:
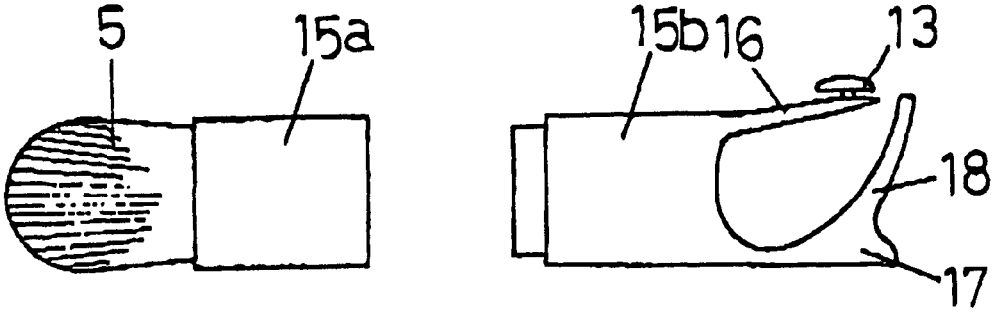
FIG. 7(*a*) is a front view of the inner tubular case according to another embodiment of the present invention, with the facial brush being detached from the body of the inner tubular case.
Figure 7:
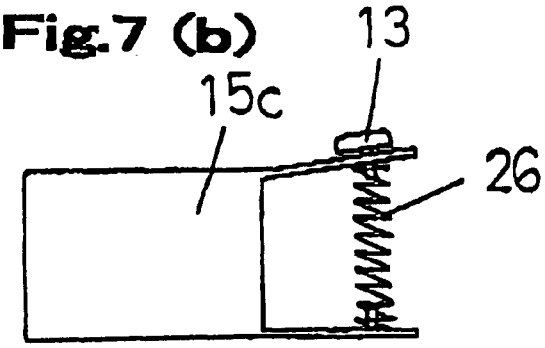
Figure 7:
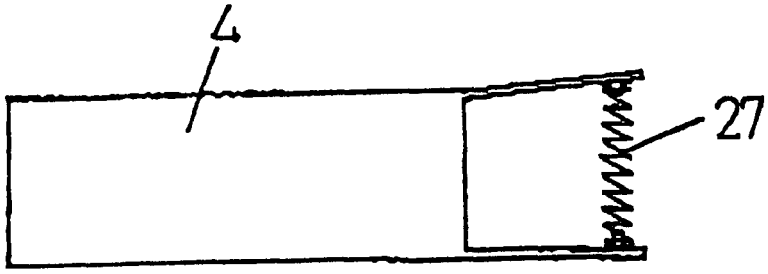

In another embodiment shown in FIG. 7(*a*), the mounting portion of the inner tubular case 6 may be divided into two parts, the front end side 15*a* and the rear end side 15*b*, wherein a facial brush 5 may be mounted removably to the front end side 15*a*, and the upper member 16 and lower member 17 may be provided contiguously behind the rear end side 15*b*.

In this embodiment, different types of makeup sets or cosmetic articles may be mounted interchangeably to the front end side 15*a* of the mounting portion. The front end side 15*a* may be combined with the rear end side 15*b* by fitting the former around the latter, and they may be used as a single unit.

In a further embodiment shown in FIG. 7(*b*), a variation of the inner tubular case is provided as shown by 15*c*, wherein the operating member 13 is normally urged by a spring 26 toward its raised position.

In still another embodiment shown in FIG. 7(*c*), a variation of the intermediate tubular case is provided as shown by 4*a*, wherein the upper member 12 in the first embodiment is replaced by an upper member 28 that is loaded with a spring 27.

Although the present invention has been described in reference with the particular preferred embodiments thereof, it should be understood that various changes and modifications may be made without departing from the spirit and scope of the invention as defined in the appended claims.

It has been described that the outer tubular case and intermediate tubular case have a square shape in cross section, respectively, It should be understood, however, that the present invention is not limited to this shape, but any other shapes may be employed, such as round, triangle, polygonal and like shapes.

What is claimed is:

1. A storage case for a makeup set or cosmetic article that is designed to store the makeup set or cosmetic article so that it can be moved out of or back into the storage case, said storage case comprising:

an outer tubular cas equipped with a lid or cover at one end thereof;

an intermediate tubular case mounted slidably inside said outer tubular case; and an inner tubular case mounted slidably inside said intermediate tubular case, said inner tubular case holding the makeup set or cosmetic article securely therein, wherein said storage case further includes:

first locking means for permitting said intermediate tubular case to be locked to said outer tubular case;

second locking means for permitting said inner tubular case to be locked to said outer tubular case; and engaging/disengaging means for permitting said inner tubular case and said intermediate tubular to disengageably engage each other.

2. The storage case as defined in claim 1, wherein said first locking means on the intermediate tubular case includes an engaging recess on the outer tubular case and projection on the intermediate tubular case for disengageably engaging the engaging recess.

3. The storage case as defined in claim 1, wherein said second locking means on the inner tubular case includes an engaging recess on the outer tubular case and an operator member on the inner tubular case for disengageably engaging the engaging recess.

4. The storage case as defined in claim 1, wherein said engaging/disengaging means includes a bearing portion provided on the intermediate tubular case and a rising member provided on the inner tubular case for engaging the bearing portion.

* * * * *